US008267194B2

(12) United States Patent
Saf

(10) Patent No.: US 8,267,194 B2
(45) Date of Patent: Sep. 18, 2012

(54) ROTATION DEVICE FOR A BOOM OF A MINING OR CONSTRUCTIONS WORK RIG, RIG AND BOOM

(75) Inventor: Fredrik Saf, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 932 days.

(21) Appl. No.: 11/795,833

(22) PCT Filed: Feb. 17, 2006

(86) PCT No.: PCT/SE2006/000217

§ 371 (c)(1), (2), (4) Date: Jul. 23, 2007

(87) PCT Pub. No.: WO2006/096110

PCT Pub. Date: Sep. 14, 2006

(65) Prior Publication Data

US 2008/0093525 A1 Apr. 24, 2008

(30) Foreign Application Priority Data

Mar. 11, 2005 (SE) ..... 0500560

(51) Int. Cl.
*E21C 25/06* (2006.01)

(52) U.S. Cl. ..... 173/190; 173/44

(58) Field of Classification Search ..... 173/190, 173/28, 184, 42, 44, 192, 193
See application file for complete search history.

(56) References Cited

U.S. PATENT DOCUMENTS

| | | | | |
|---|---|---|---|---|
| 2,491,273 | A * | 12/1949 | Lehner | 173/150 |
| 3,354,967 | A * | 11/1967 | Skendrovic | 173/194 |
| 3,782,484 | A | 1/1974 | Martin | |
| 7,644,782 | B1 | 1/2010 | Coogan et al. | |

FOREIGN PATENT DOCUMENTS

| | | | |
|---|---|---|---|
| EP | 0434652 | | 6/1991 |
| EP | 434652 | A1 * | 6/1991 |
| GB | 2028693 | A * | 3/1980 |
| GB | 2189724 | A * | 11/1987 |
| JP | 2003-502532 | | 1/2003 |
| WO | WO 00/34617 | | 6/2000 |

* cited by examiner

*Primary Examiner* — Sunil Singh
(74) *Attorney, Agent, or Firm* — Mark P. Stone

(57) ABSTRACT

A rotation device (12) for rotation of equipment (13) fastened at the region of a distal end of a boom (9,11), which has a general longitudinal axis, and which is part of a boom device (3) which is fastenable to a carrier (2) for a mining or constructions work rig, wherein the rotation device includes a first rotation unit (R1) arranged to rotate the equipment around an axis (A1) which is essentially parallel to the longitudinal axis of the boom and a second rotation unit (R2) which is arranged to rotate the equipment around an axis (A2), which forms an angle with the longitudinal axis of the boom. The rotation units (R1, R2) are fastened to an angle unit (12'), which is included in the rotation device (12) and has rotational axes (A1, 21; A2,22) extending at an angle with respect to each other, and are connectable to the boom (9,11) as well as to said equipment (13). The invention also concerns a mining or constructions work rig and a boom.

17 Claims, 2 Drawing Sheets

ROTATION DEVICE FOR A BOOM OF A MINING OR CONSTRUCTIONS WORK RIG, RIG AND BOOM

FIELD OF THE INVENTION

The invention concerns a rotation device for a boom of a mining or construction work rig. The invention also concerns a rig and a boom including such a rotation device.

BACKGROUND OF THE INVENTION

From EP-B1-0 434 652, such a device is previously known in a telescopic boom arrangement, wherein a rotation motor at a rear end of a first boom portion is arranged to rotate a second boom portion. A rotation motor is positioned at the outer end of a second boom portion, which allows rotation of a feed beam for a rock drilling machine.

Through this arrangement, the rock drilling boom is maneuverable such that an operator can relatively easily position the feed beam in the desired position and direction with six degrees of freedom. The known device, however, makes it more difficult to make it possible to position with high precision, which is more and more essential for today's users. Because of the positioning and the arrangement of the first rotation motor, a certain rotational deviation that can not be neglected will be the result of play and deformation, which in practice makes it impossible to adjust with high precision.

AIM AND MOST IMPORTANT FEATURES OF THE INVENTION

It is an aim with the present invention to provide a rotation device according to the above, wherein the problem of the background art is eliminated or at least essentially reduced. It is further an aim of the invention to provide a rotation device as above, wherein a flexible and economically realised solution is obtained, which also makes adjustment with high precision possible.

Hereby it is achieved that a telescopic boom and thereby the rig as a whole can be manufactured compactly, and besides, which is a great advantage, allows modularisation through the use of standard components such as standard rotation actuators and a standard boom.

Through one embodiment of the invention, wherein the first rotation unit provides a separating place at its outgoing rotational axis, there is achieved a possibility of having a releasable connection with a boom, which i.a. gives the advantage that the same boom, and the same mining or constructions work rig can be easily employed for different uses, wherein the equipment to be used is connectable at said separating place.

By also providing a separating place at the second rotation unit, the corresponding advantages are achieved, and further more that the whole rotation device is releasable from the boom and the equipment and thereby easily exchangeable and/or removable for service.

By providing the rotation device/angular device with an open or openable intermediate portion, simple access is possible from the outside of the respective rotation actuator for service, exchange etc.

By providing a toothed transmission unit, and in particular a planet gear transmission unit for transmitting the movement of the respective rotation actuator, the simplicity and compactness of the device is accentuated.

According to the invention, the boom portions can advantageously be manufactured with non-circular cross section so that the complete boom can be made more rigid and with more loading capacity and be less susceptible to play.

The corresponding advantages are achieved according to the invention in a rig and a boom including such a rotation device.

BRIEF DESCRIPTION OF DRAWINGS

The invention will now be described to the background of embodiments and with reference to the annexed drawings, wherein.

DESCRIPTION OF EMBODIMENTS

Figure 1:
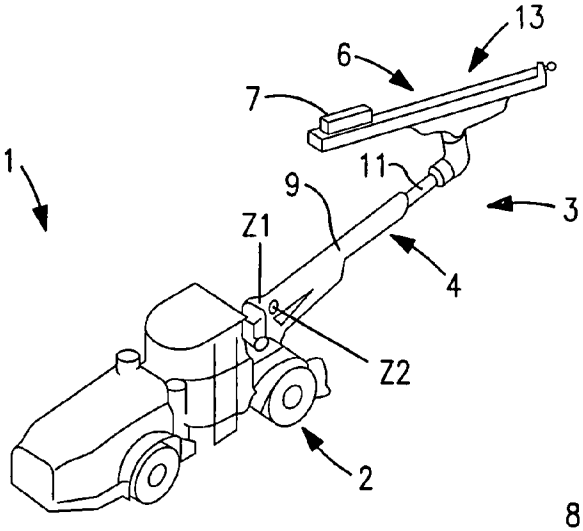
FIG. 1 in general shows a mining rig according to the invention.

In FIG. 1 reference numeral 1 in general concerns a rig in the form of a mining machine, which in this case is a machine for drilling of a blast hole and for applying rock reinforcements respectively. The mining machine 1 includes a carrier 2 having conventional driving arrangements and an operator cabin, wherein a boom device 3 is attached to the carrier. The boom device 3 includes a telescopic and liftable and lowerable boom 4, at the outer end of which being fastened equipment 13 for e.g. rock drilling, including a feeder 6 and a rock drilling machine 7. Z1 and Z2 indicate rotational axes for the boom device. Further rotational axes are described in the following.

Figure 2:
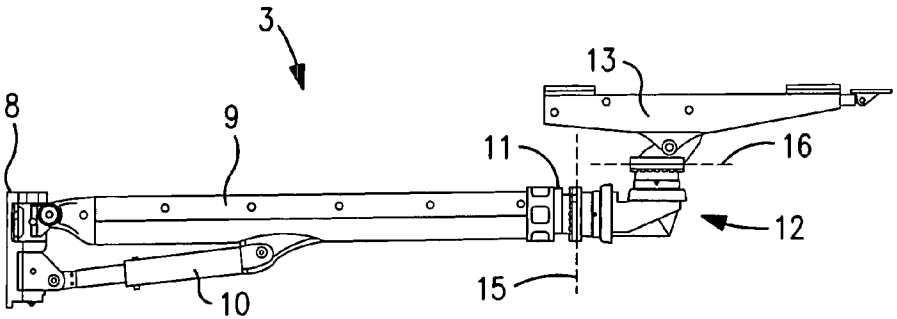
FIG. 2 shows a part of a rig according to the invention in a side view.

FIG. 2 shows the boom device 3 in greater detail including a carrier attachment 8 and the telescopic boom, which includes a first boom portion 9 and a second boom portion 11 which is almost entirely retracted in the Figure (see the boom portions more drawn apart in FIG. 1). The boom 9, 11 is manoeuvred for lifting and lowering by means of two lifting cylinders 10 (are shown best in FIG. 3).

Distal on the second boom portion 11 there is arranged a rotation device 12 which is separable at a first separating place which is indicated with an interrupted line at 15, said rotation device being separable also with respect to a feed beam holder 13 at a second separating place which is indicated with an interrupted line at 16.

The shown boom has five degrees of rotational freedom and one degree of translation freedom. The feeding displacement for the rock drilling machine is thereby not included. In particular it is preferred that the possibility to rotate about the longitudinal axis of the boom exceeds 360° . It is further preferred that the possibility to rotate about the axis defining an angle with respect to the longitudinal axis of the boom exceeds about 90° . In particular it is preferred that the rotation about this axis, at least in one direction, is so great that it makes it possible to swing the feed beam almost entirely so that its outer end is brought back to the operator cabin of the carrier vehicle. An operator can then have direct access to the drill bit for exchange or inspection without having to leave the cabin. This is possible according to the invention because of the rotation device 12, which has rotation units that are arranged in a manner to be described below.

Figure 3:
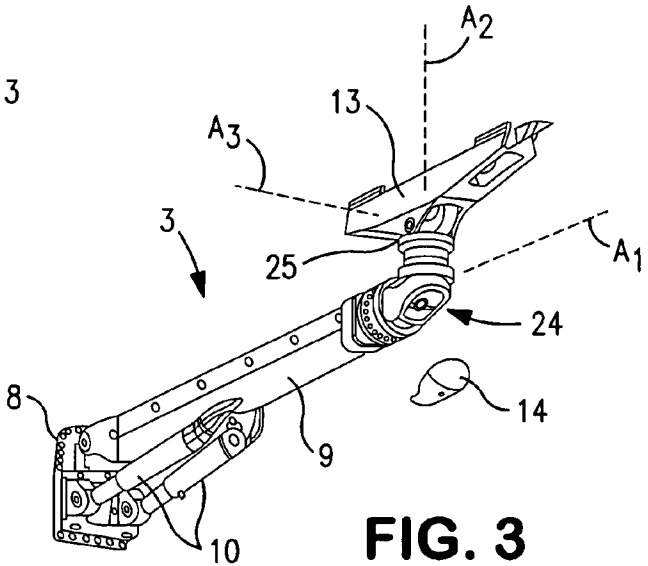
FIG. 3 shows the device according to FIG. 2 in a perspective view.

In FIG. 3 the rotation device 12 is shown in a greater detail and uncovered from a cover 14, which in operation covers the device. By removing the cover 14 an intermediate portion 24 of the rotation device 12 is uncovered, whereby is provided access from the outside to two rotation units (see also FIG. 4), wherein a first rotation unit is arranged for rotating around a general longitudinal axis A1 of the boom 9, 11. A second rotation unit is arranged for rotation of the equipment 13 applied to be other separating place 16 for rotation around an axis A2, essentially at a right angle to a general longitudinal axis A1 of the boom 9, 11.

The equipment 13 in a conventional manner includes a pivot joint 25 with a (not shown) hydraulic cylinder for pivoting the feeder around an axis A3.

Figure 4:
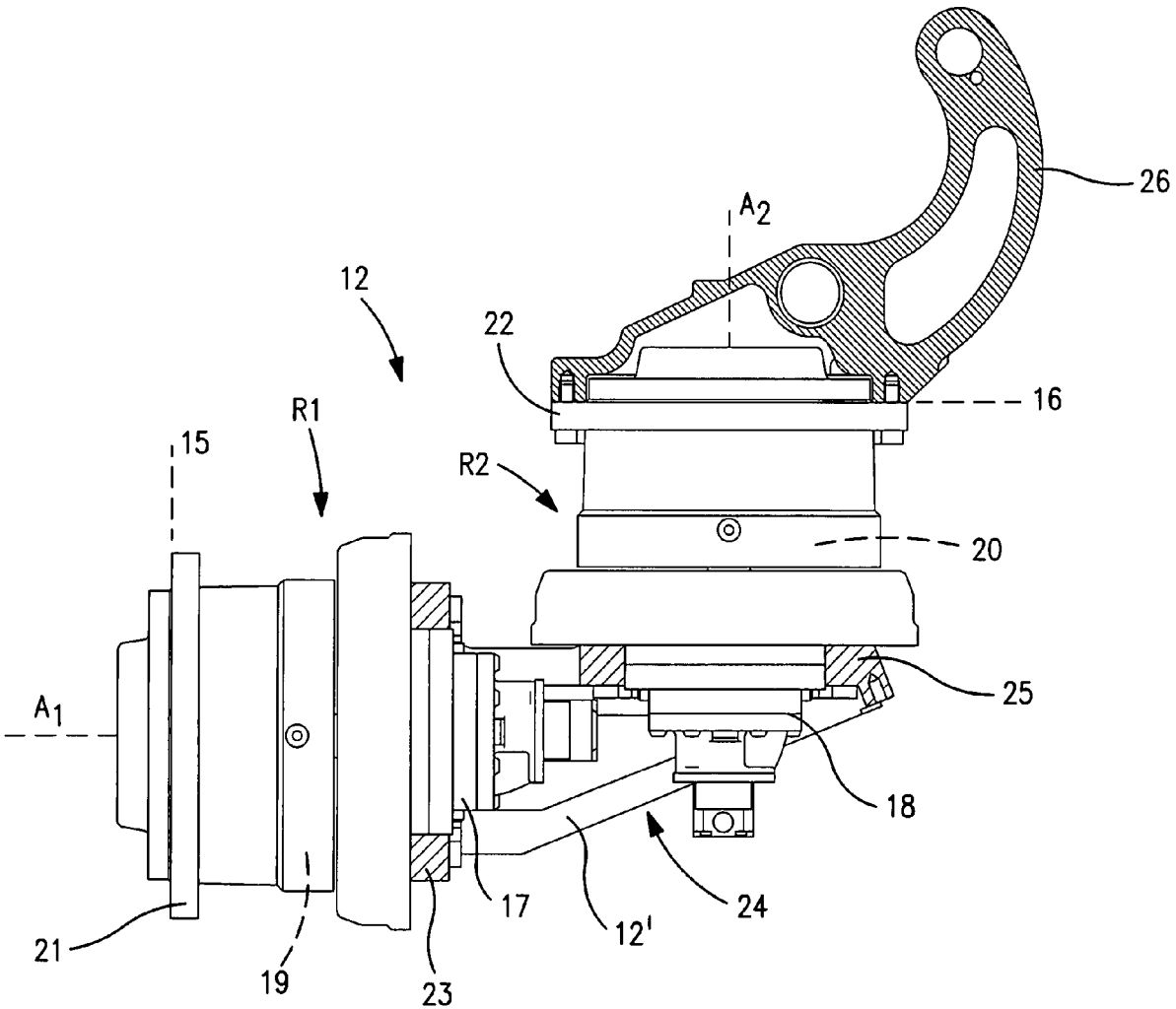
FIG. 4 shows a rotation device according to the invention, partly in section.

From FIG. 4 is shown the rotation device 12 separated from the boom 9, 11 at the separating place 15. Of the equipment 13 is shown a fastener bracket 26, which is attached to the rotation device at the second separating place 16. In more detail the rotation device 12 includes a body in the form of an angle unit 12', which has two mutually angled attachments for rotation motors, so that two rotation motors 17 and 18 are positioned in the intermediate portion 24. As an alternative, they can also be arranged otherwise in connection with the intermediate portion 24. In more detail, the first rotation motor is indicated as 17 and the second rotation motor as 18. These rotation motors 17 and 18 are fastened to the angle unit 12' on two mutually angled rotation motor attachments 23 and 25 respectively. Each rotation motor 17, 18 is over a planet gear transmission unit 19 and 20 respectively, that are not shown in more detail, each with a desired number of steps, connected to an outgoing axes Al, A2 in the form of a rotation ring 21 and 22 respectively, which are fastenable to the boom 9, 11 (rotation ring 21 for the outgoing axis A1) and to the fastening bracket 26 of the equipment 13 respectively (rotation ring 22 for the outgoing axis A2). For obtaining this attachment of the respective outgoing axis A1 and A2, these rotation rings are constructed in the form of fastening rings, which are fastened by means of screw fasteners that are distributed around the circumference and fastened to corresponding fastening flanges at the respective distal end of the second boom portion 11 and the fastening bracket 26 of the equipment 13. In particular the fastening rings (rotation rings) 21 and 22 are identical.

The invention can be modified within the scope of the following claims. The rotation device and the angular unit can thus be constructed otherwise and the arrangement for fastening thereto of the first rotation unit R1 and the second rotation unit R2 respectively can be carried out otherwise even if the solution above is preferred.

The rotation device can be used in other types of mining or constructions work equipment, for example advantageously for rock bolting machines. By the construction with simple separable units at the separating places, one and the same carrier and rig can be applied to different types of mining and construction work activities by simple exchange of the equipment positioned on the rig.

As is indicated in the figures, the cross section of the boom 9, 11 is non-circular, in particular, rectangular shaped with rounded corners, and other cross sections of the boom are also possible.

The invention claimed is:

1. Rotation device for rotation of an equipment fastened at a region of a distal end of a boom which has a general longitudinal axis, and which is part of a boom device being fastenanble to a carrier for a mining or constructions work rig, wherein the rotation device includes:

a first rotation unit with a first rotation motor adapted to rotate the equipment around said longitudinal axis, wherein the first rotation unit has a separating place at its outgoing rotational axis where said first rotation unit is releasably connectable to the boom, a second rotation unit with a second rotation motor which is arranged to rotate the equipment around an axis, which forms an angle with said longitudinal axis, wherein the second rotation unit has a separating place at its outgoing rotational axis where said second rotation unit is releasably connectable to the equipment, wherein said first and second rotation units are fastened to an angle unit included in the rotation device, wherein the angle unit has an intermediate portion defining an opening therein for providing access from outside to the rotation motors of the first and second rotation units, and a cover for selectively opening or closing the opening in said intermediate portion for providing or preventing access to said rotation motors of said first and second rotation units.

2. The device according to claim 1, wherein said angle is essentially 90° .

3. The device according to claim 2, wherein each rotation motor is arranged to transmit rotational movement over a toothed gear unit.

4. The device according to claim 2, wherein the intermediate portion is limited by two mutually angled rotation motor attachments whereto the rotation motors are fastened so that they are arranged in connection with the intermediate portion.

5. The device according to claim 1, wherein the intermediate portion is limited by two mutually angled rotation motor attachments whereto the rotation motors are fastened so that they are arranged in connection with the intermediate portion.

6. The device according to claim 1, wherein each rotation motor is arranged to transmit rotational movement over a toothed gear unit.

7. The device according to claim 6, wherein said toothed gear unit is a planet gear transmission unit.

8. A mining or constructions work rig including a boom and a rotation device according to claim 1.

9. The rig according to claim 8, wherein the boom includes a first boom portion which is arranged to be pivotally connected to said carrier and a second boom portion which is arranged telescopically displaceable with respect to the first boom portion.

10. The rig according to claim 9, wherein at least one of the first and the second boom portions has at least a partially non-circular cross section.

11. The rig according to claim 10, wherein said cross section is rectangular.

12. The rig according to claim 10, wherein the equipment includes a pivot joint with a pivoting motor.

13. The rig according to claim 9, wherein the equipment includes a pivot joint with a pivoting motor.

14. The rig according to claim 8, wherein the equipment includes a pivot joint with a pivoting motor.

15. A boom for a mining or constructions work rig, wherein said boom is connected to said first rotation unit of said rotation device according to claim 1.

16. A mining or constructions work rig including a boom and a rotation device according to claim 2.

17. A boom for a mining or constructions work rig, the boom connected to the first rotation unit of the rotation device according to claim 2.

* * * * *